US011313345B2

(12) United States Patent
Viard

(10) Patent No.: US 11,313,345 B2
(45) Date of Patent: Apr. 26, 2022

(54) CYLINDER BLOCK COMPRISING PISTON-HOLDING MEANS

(71) Applicant: POCLAIN HYDRAULICS INDUSTRIE, Verberie (FR)

(72) Inventor: Julien Viard, Verberie (FR)

(73) Assignee: POCLAIN HYDRAULICS INDUSTRIE, Verberie (FR)

( * ) Notice: Subject to any disclaimer, the term of this patent is extended or adjusted under 35 U.S.C. 154(b) by 3 days.

(21) Appl. No.: 16/972,883

(22) PCT Filed: Jun. 4, 2019

(86) PCT No.: PCT/FR2019/051309

§ 371 (c)(1),
(2) Date: Dec. 7, 2020

(87) PCT Pub. No.: WO2019/234342

PCT Pub. Date: Dec. 12, 2019

(65) Prior Publication Data

US 2021/0254597 A1 Aug. 19, 2021

(30) Foreign Application Priority Data

Jun. 8, 2018 (FR) ..... 1855009

(51) Int. Cl.
*F03C 1/04* (2006.01)
*F03C 1/30* (2006.01)

(52) U.S. Cl.
CPC ..... *F03C 1/0419* (2013.01); *F03C 1/0409* (2013.01); *F03C 1/0428* (2013.01)

(58) Field of Classification Search
CPC .... F03C 1/0428; F03C 1/0419; F03C 1/0409; F03C 1/047
See application file for complete search history.

(56) References Cited

U.S. PATENT DOCUMENTS

| | | | |
|---|---|---|---|
| 3,922,956 | A | 12/1975 | Foster |
| 4,469,012 | A | 9/1984 | Bigo et al. |
| 4,704,948 | A | 11/1987 | Wusthof et al. |
| 5,632,191 | A | 5/1997 | Lemaire et al. |

FOREIGN PATENT DOCUMENTS

| | | | |
|---|---|---|---|
| DE | 3530979 | A1 | 3/1987 |
| FR | 2160120 | A5 | 5/1973 |
| FR | 2504987 | A1 | 11/1982 |
| FR | 2727471 | A1 | 5/1996 |
| FR | 3049990 | A1 | 10/2017 |

*Primary Examiner* — F Daniel Lopez
(74) *Attorney, Agent, or Firm* — The Webb Law Firm

(57) ABSTRACT

The assembly may include a cylinder block, a plurality of pistons, and a holding element, the holding element extending over all or part of the outer periphery of the cylinder block. The holding element may include a plurality of guide portions, each partially blocking a recess of the cylinder block so as to come into contact with a planar end of the crown of a piston to guide in the translation of each piston in their respective recesses. The holding element may include two indexing means cooperating with two indexing means of the cylinder block so as to hold the holding element under a traction force when positioned around the cylinder block.

20 Claims, 5 Drawing Sheets

CYLINDER BLOCK COMPRISING PISTON-HOLDING MEANS

CROSS-REFERENCE TO RELATED APPLICATIONS

This application is the United States national phase of International Application No. PCT/FR2019/051309 filed Jun. 4, 2019, and claims priority to French Patent Application No. 1855009 filed Jun. 8, 2018, the disclosures of which are hereby incorporated by reference in their entirety.

BACKGROUND OF THE INVENTION

Field of the Invention

The present disclosure relates to hydraulic machines, and more precisely the cylinder blocks of hydraulic machines.

Prior Art

Radial piston hydraulic machines comprise a plurality of pistons disposed in the recesses of a cylinder block, arranged radially around a central axis, so as to slide depending on the relative rotation of the cylinder block relative to a multi-lobe cam.

The pistons must however be held in a given orientation within their recesses in order to ensure good contact with the multi-lobe cam. To this end, it is known in particular to position a radial clip linked on the one hand to the cylinder block, and lodging on the other hand in a groove provided in the piston supports. Document FR2727471 presents a solution of this kind.

Although satisfying in a majority of situations, this existing solution is constraining in terms of assembly, in that it requires individual positioning of each of the clips on the pistons, as well as the creation of additional components and their individual positioning to serve as supports for the clips.

Also known are assemblies in which the holding elements are positioned on the outer periphery of the cylinder block in order to accomplish guiding of the pistons, these holding elements then being mounted by means of bolts or rivets so as to accomplish flat grasping of the holding element tending to apply them against the cylinder block. Such assemblies have similar problems in that they require multiple operations for the assembly of each cylinder block.

The present disclosure thus intends to respond at least partially to these problems.

SUMMARY OF THE INVENTION

To this end, the present disclosure relates to an assembly comprising:

a cylinder block having a plurality of recesses extending radially around a central axis, and leading to an outer periphery of the cylinder block, a plurality of pistons, each disposed in a recess of the cylinder block having a cylinder-of-revolution cross section around a piston axis extending radially around the central axis, and mounted sliding radially relative to the central axis, each of said pistons having a body and a crown suited to come into contact with a multi-lobe cam, the crown having the shape of a cylinder of revolution and two planar ends each in a plane perpendicular to the central axis and defining guide surfaces, a holding element extending over all or a part of the outer periphery of the cylinder block, the holding element comprising a plurality of guide portions, each partially blocking a recess of the cylinder block, so as to come into contact with a planar end of the crown of a piston so as to accomplish the guiding in translation of each of the pistons in their respective recesses, characterized in that the holding element comprises two indexing means cooperating with two indexing means of the cylinder block so as to hold the holding element under a traction force when positioned around the cylinder block.

According to one example, the holding element comprises a body having the shape of a circular arc extending around the outer periphery of the cylinder block, and comprises holding sections extending perpendicular to said body, parallel to the central axis and from two ends of the body, said holding sections forming the indexing means of the holding element.

As a variant, the cylinder block comprises holding cavities provided on the outer surface of the cylinder block, into which are inserted the holding sections of the holding element.

The holding element then typically comprises a channel extending on its outer surface, and in which an elastic element is positioned in said channel so as to clasp the holding element around the cylinder block.

According to one example, the holding element is made of plastic material.

Each guide portion of the holding element is then typically formed in a material comprising one material among molybdenum sulfide, graphite or bronze.

According to one example, each of the guide portions defines a linear or planar contact with a planar end of the crown of a piston, the contact being respectively on an axis extending radially relative to the central axis, or in a plane perpendicular to the central axis of the cylinder block.

According to one example, each guide portion is bracketed by two notches, each defining a passage for a portion of the body of a piston beyond the holding element in the radial direction relative to the central axis.

As a variant, the body of each piston has a cylinder-of-revolution shape along a piston axis extending radially relative to the central axis, and in which is formed a crown recess defining a cylinder-of-revolution cavity along an axis perpendicular to the piston axis, said crown recess leading to one end of the piston body relative to the piston axis, the intersection between the outer surface of the piston body and the crown recess defining portions suited to penetrate into the notches of the holding element during the translation movement of the piston in its recess.

According to one example, the holding element has a radial portion extending radially relative to the central axis, the radial portion comprising a plurality of relief elements distributed regularly around the central axis.

Each of said relief elements then typically comprises a magnetic or ferromagnetic material, typically integrated in the form of a filler distributed within the material forming the relief elements of the holding element.

According to one example, the holding element is composed of two segments, said two segments forming an annulus or a split annulus when placed end to end.

As a variant, the holding element is a split annulus.

According to one example, the assembly comprises two holding elements extending on either side of the recesses of the cylinder block.

The present disclosure also relates to a radial piston hydraulic machine comprising an assembly as previously defined.

BRIEF DESCRIPTION OF THE DRAWINGS

The invention and its advantages will be better understood upon reading the detailed description given hereafter of different embodiments of the invention given by way of non-limiting examples. This description refers to the appended pages of figures, in which.

In all the figures, common elements are labeled with identical numerical references.

DETAILED DESCRIPTION OF THE INVENTION

Figure 1:
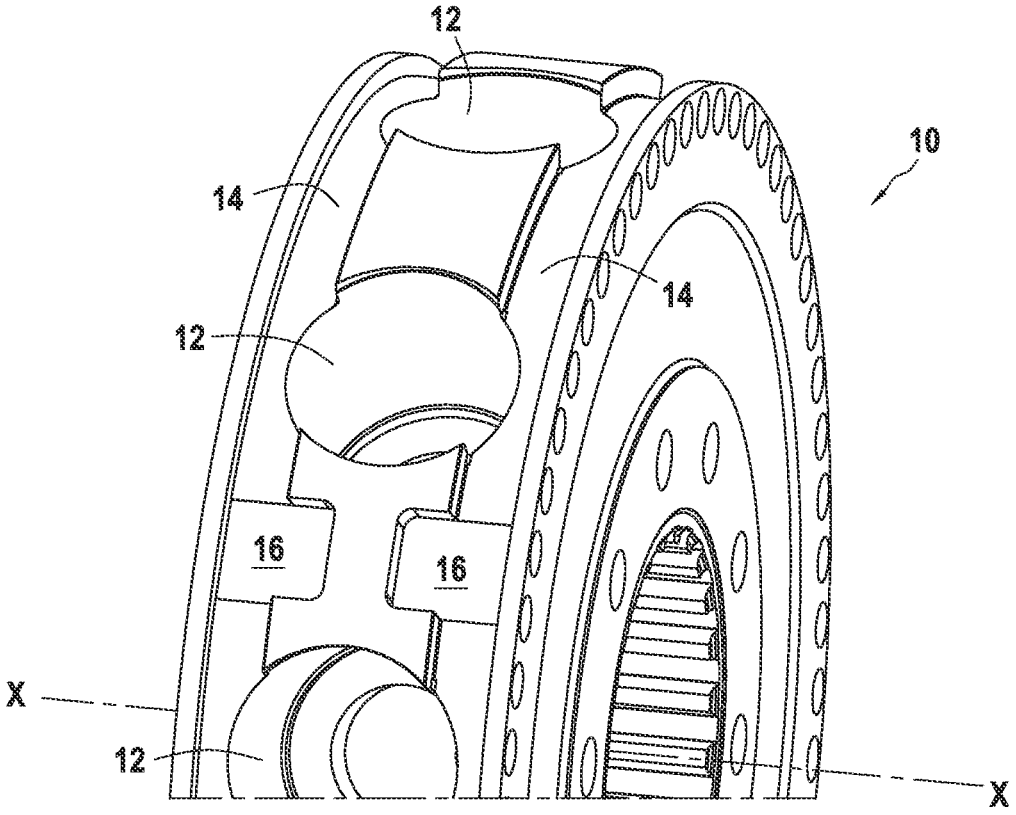
FIG. 1 shows a partial view of a cylinder block of a radial piston hydraulic machine equipped with a holding element according to one aspect of the present invention.
Figure 2A:
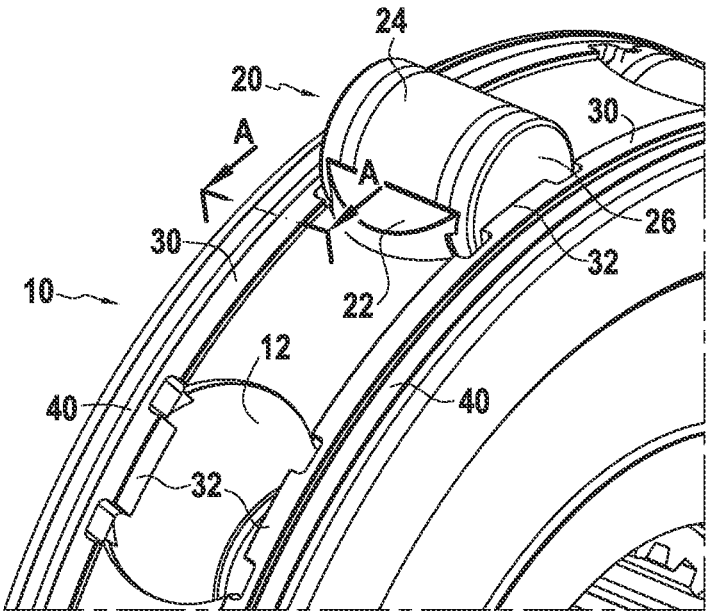
FIG. 2A shows a partial view of a cylinder block of a radial piston hydraulic machine equipped with a holding element according to one aspect of the present invention.
Figure 2B:
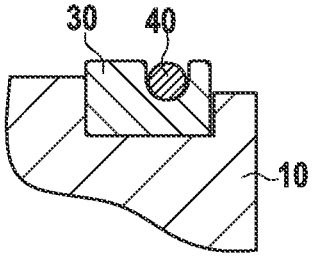
FIG. 2B shows a partial section view illustrating a variant of the holding element according to one aspect of the present invention.
Figure 2C:
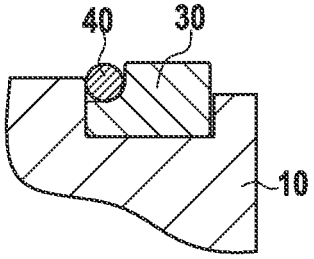
FIG. 2C shows a partial section view illustrating a variant of the holding element according to one aspect of the present invention.
Figure 3:
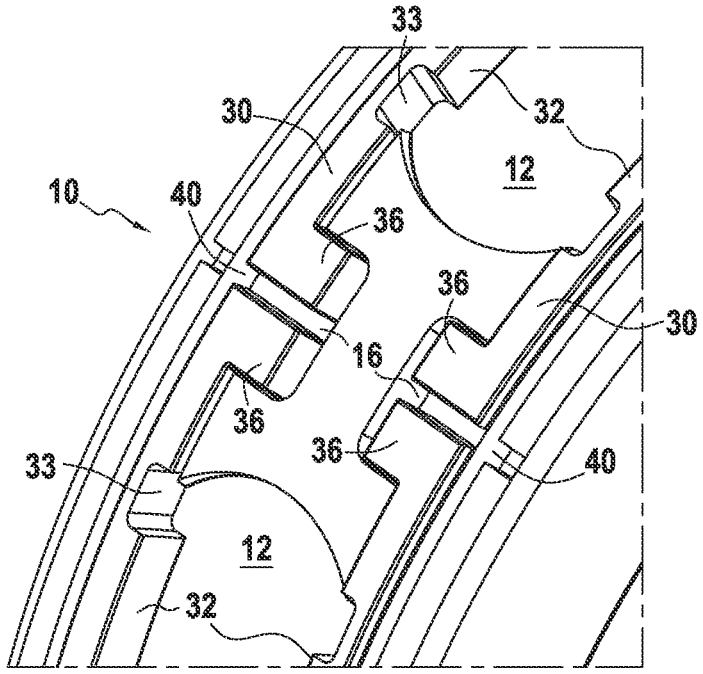
FIG. 3 shows a partial view of a cylinder block of a radial piston hydraulic machine equipped with a holding element according to one aspect of the present invention.

FIGS. 1-3 show several partial views of a cylinder block 10 of a radial piston hydraulic machine. The cylinder block 10 extends around a central axis X-X, corresponding to a relative rotation axis of a hydraulic machine rotor and a stator in which the cylinder block 10 is suited to be mounted.

The cylinder block 10 comprises a plurality of recesses 12 each extending radially relative to the central axis X-X, and leading to the outside periphery of the cylinder block 10. Each of these different recesses 12 is adapted to receive a piston 20, mounted sliding in a radial direction relative to the central axis X-X and suited to come into contact with a multi-lobe cam positioned around the cylinder block 10. Each of the recesses 12, moreover, is connected to ducts provided in the cylinder block, in order to c a fluid into the bottom of each recess.

Each of the pistons 20 typically comprises a body 22 forming a support for a crown 24 suited to come into contact with the multi-lobe cam. A slide plate can be interposed between the body 22 and the crown 24.

Such elements are well known and define a radial piston hydraulic machine.

Figure 4:
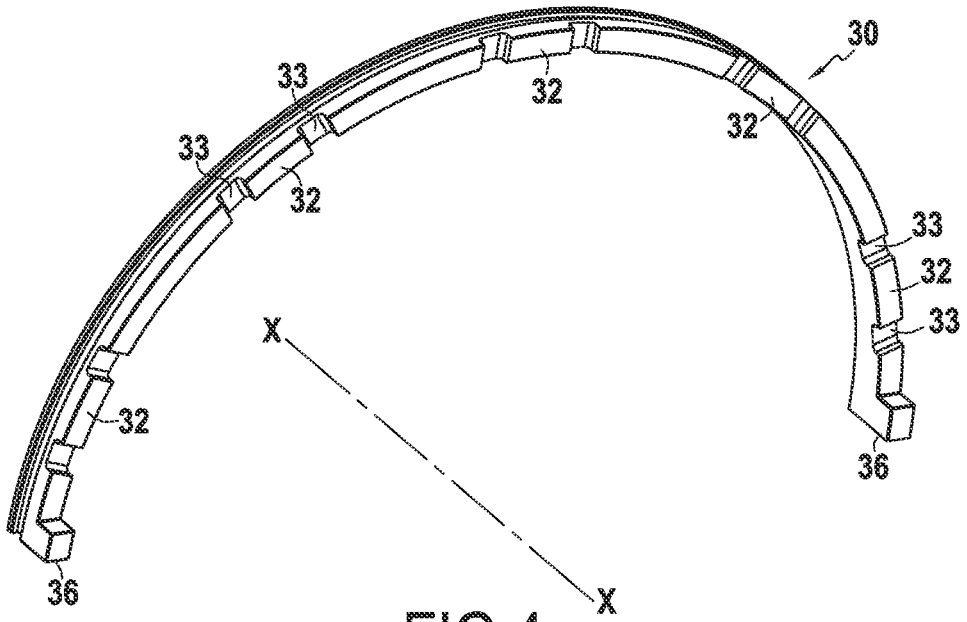
FIG. 4 shows a holding element according to one aspect of the present invention.

The cylinder block 10 as shown also comprises a holding element 30 configured so as to accomplish holding of the pistons 20, and more precisely so as to ensure holding of the orientation of the crowns 24 of the pistons 20. FIG. 4 shows a first example of a holding element 30 according to one aspect of the invention, and FIGS. 2A and 3 show the cylinder block 10 equipped with holding elements 30 of this type. The holding element 30 is typically made of plastic material, typically by injection. The holding element 30 can also be made of metallic material, typically machined or molded, for example of steel, or of copper-based material for sliding.

The holding element 30 as shown has a generally semi-circular shape. It is suited to be positioned around the outer periphery of the cylinder block 10, in channels 14 extending on the outer periphery of the cylinder block 10, on either side of the recesses 12 relative to the central axis X-X. More generally, the holding element 30 has a body forming a segment of a circle around the central axis X-X.

The channels 14 partly straddle the recesses 12, so that the holding elements 30 positioned in the channels are partly positioned in the recesses 12. In the embodiment shown, each of the holding elements 30 has a plurality of guide portions 32 having a rectangular parallelepiped cross section, suited to come into contact with the pistons 20. More precisely, in the embodiment shown, the crowns 24 of the pistons 20 have planar surface 26 at their two ends in the direction defined relative to the central axis X-X. Each of the guide portions 32 of the holding elements 30 then having a face extending in a plane perpendicular to the central axis X-X, which then comes into contact with these planar surfaces 26 of the crowns 24, thus defining guidance by planar contact.

Thus it is understood that the pistons 20 are each mounted sliding in a cylindrical recess 12. The shape of the pistons 20 and the recesses 12 allows translation movement in a radial direction relative to the central axis X-X of each of the pistons 20 in its recess 12, and also a rotation of the pistons 20 in the recesses 12 around an axis of rotation defined by the radial direction of translation of each of the pistons.

The planar contact between the pistons 20 (via the planar surfaces 26 of the crowns 24 here) and the holding elements 30 allows preventing the rotation of the pistons 20 in the recesses 12, while retaining the radial translation movement of the pistons 20 in their recesses 12.

More generally, the holding elements 30 are configured so as to limit the offset of the pistons 20 in rotation in their respective recesses 12, so as to retain sufficient alignment between the crowns 24 of the pistons 20 and a multi-lobe cam positioned around the cylinder block 10.

The guide portions 32 of the different holding elements can have several geometries and accomplish different types of contact with the pistons 20.

The example described previously with reference to the figures thus has a contact between two planar surfaces.

As a variant, each guide portion 32 can define one or more linear contacts or one or more point contacts with the associated piston 20.

The guide portion 32 can thus have one or more ribs extending radially or extending in the continuation of the outer periphery of the cylinder block 10, each defining a linear contact with a planar surface of the piston 20, and/or one or more protrusions each defining a point contact with a planar surface of the piston 20.

Contacts of this type between the guide portion 32 and the piston 20 ensure a null or strongly reduced offset in rotation of the piston 20 in its recess 12, which thus allows obtaining an alignment between the crowns 24 of the pistons 20 and a multi-lobe cam positioned around the cylinder block 10 as indicated previously. By way of an example, the offset in rotation of the piston 20 around an axis extending radially relative to the central axis X-X is thus less than 10°, or even less than 5°, or even less than 3°, or more precisely less than 1°.

The guide portion 32 also achieves comes into contact with the body 22 of the piston 20, more precisely in contact with a portion of the body 22 defining a recess for the crown 24. The guide portion 32 thus achieves an abutment function for the sliding movement of the piston 20 in its recess 12, and allows preventing departure of the piston 20 from its recess 12.

This function is particularly advantageous for the pistons in which the body 22 achieves retention of the crown 24. The body 22 then typically has two portions extending beyond the median plane of the crown 24, perpendicular to the sliding direction of the piston 20, and the body 22 thus surrounds more than half of the outer contour of the crowns 24 (i.e. more than 180°), thus accomplishing retention of the crowns 24 in the radial direction relative to the central axis X-X.

The holding element 30 as proposed, associated with a cylinder block 10 equipped with pistons 20 of this type allows proposing an assembly which can be easily manipulated by a user, without risking the pistons 20 or the crowns 24 falling, and is in particular advantageous for the assembly of a hydraulic machine or within the scope of supplying spare parts.

The guide portions 32 are typically formed in a material comprising one material among molybdenum sulfide, graphite or bronze positioned so as to be in contact with the piston 20. This material is typically injected as a filler into the material in which the holding element 30 is formed.

Figure 9:
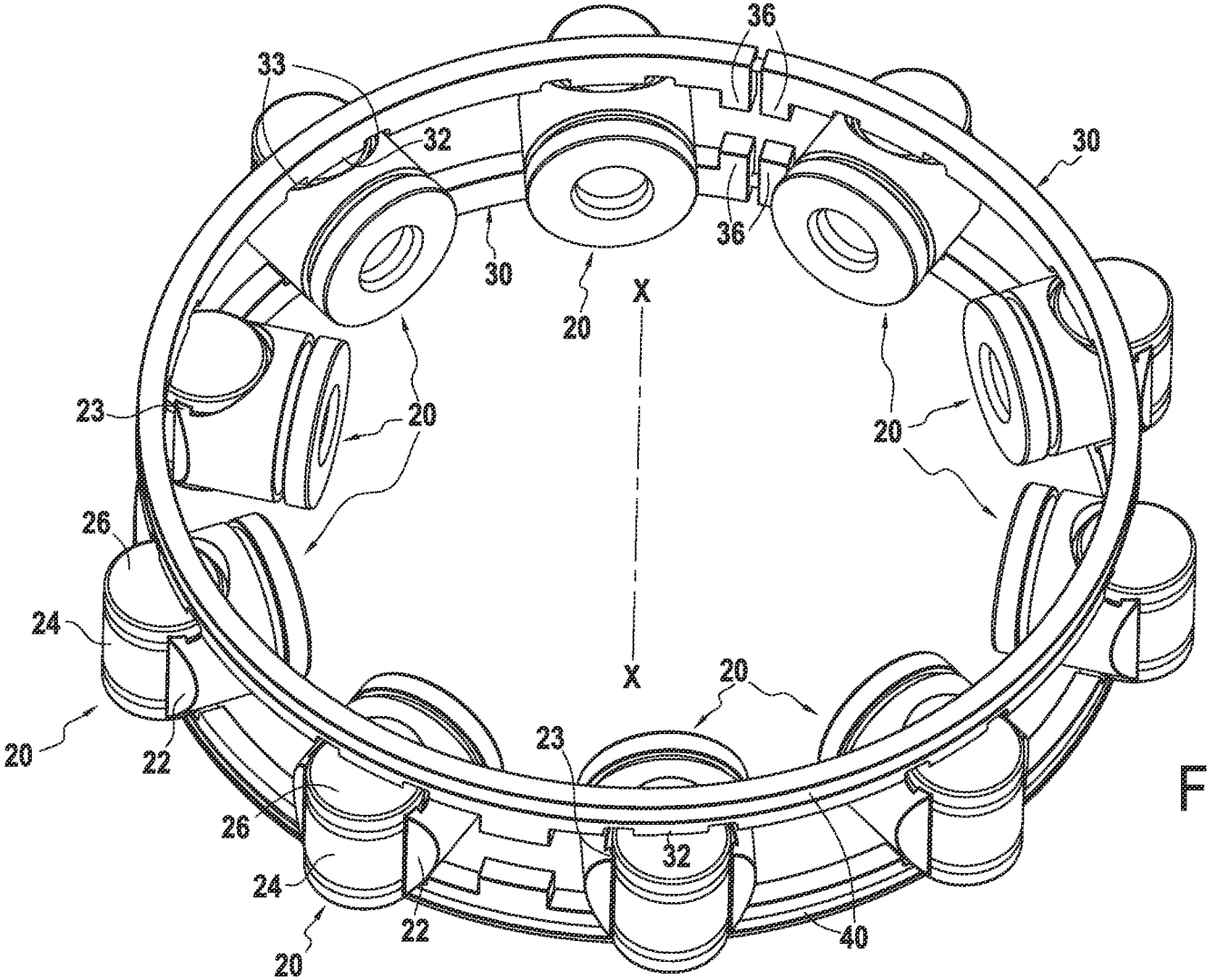
FIG. 9 shows pistons and a holding element in isolation.

The guide portions 32 are typically bracketed by notches 33. The notches 33 are so dimensioned as to allow a piston 20 to carry out a sliding movement of the desired amplitude without this sliding movement being prevented by the body 22 of the piston 20 coming into abutment with the holding element 30. In fact, in the absence of such notches 33, it would then be necessary to machine the body 22 of the piston 20 in order to form flats to avoid having the holding element 30 interfere with the sliding motion of the piston 20 in its recess 12. FIG. 9 illustrates this function schematically, by showing a plurality of pistons 20 in different positions relative to the holding element 30 (the cylinder block 10 has been eliminated from this view for the purpose of illustration). As can be seen in this figure, when the piston 20 is in a position corresponding to the maximum designed excursion from its recess, portions 23 of the body 22 of the piston 20 extend beyond the holding element 30 while passing through the notches 33.

The notches 33 of the holding element 30 cooperate advantageously with a piston 20 of the type having a cylindrical crown recess, the cylindrical shape of the crown recess intersecting the cylindrical surface of the piston 20, thus forming two edges on each side of the piston 20, each of which passes partially into the notches 33 during the stroke of the pistons 20 in the cylinder block 10. The notches 33 thus allow considerable simplification of the machining operations necessary for the production of the piston 20. By way of an example, the piston body can thus have the general shape of a cylinder of revolution with a piston axis extending radially relative to the central axis X-X. The piston body 24 comprises a crown recess defining a cylinder-of-revolution through bore with an axis perpendicular to the axis of the piston, and leading to the radial outer end of the piston body 24. The intersection of the body 23 and the crown recess then defines the portions 23 penetrating into the notches 33 during the translation movement of the pistons 20 in their recesses 12.

In order to ensure the holding in position of the holding elements 30 around the cylinder block 10, the latter typically has on its radial periphery one or more holding cavities 16 extending from the channels 14, and in which are positioned holding sections 36 of the holding elements 30 extending from the ends of the holding element 30.

The holding sections 36 typically have the shape of sections disposed perpendicularly relative to a principal cross section of the holding element 30, and therefore extending in the direction of the central axis X-X when the holding element 30 is positioned around the cylinder block 10.

The holding sections are thus inserted into the holding cavities 16 of the cylinder block 10, and thus ensure the holding in position of the holding elements 30 relative to the cylinder block 10, and in particular avoiding a rotation of the holding elements 30 around the cylinder block 10. It is understood in fact that the guide portions 32 must be held in position at the recesses 12 of the cylinder block 10, which the holding sections 36 and the holding cavities 16, which thus accomplish a function of indexing the holding element 30 relative to the cylinder block 10, make it possible to ensure.

The holding sections 36 and the holding cavities 16 are configured so that their engagement requires subjecting the holding element 30 to a traction force. Several configurations are then possible. The holding element 30 can be held under a traction force when engaged with the holding sections 36 of the holding cavities 16; it is thus held in position around the cylinder block 10 by the effect of elasticity. It is possible that the holding element 30 is free, or even has a slight clearance when it is engaged. The holding sections 36 and the holding cavities 16 are then configured so that an elastic deformation is necessary in order to engage them, for example by having to pass beyond a lug, the holding element 30 then returning to an unconstrained condition. More precisely, the holding element 30 is subjected to a traction force tending to extend it in its greatest dimension (or its length), i.e. tending to extend the dimension of the circular arc defined by the holding element 30. The holding element 30 is thus subjected to a tension force tangential to the outer periphery of the cylinder block 10. An extension of this type of the holding element 30 over its entire length allows a significant extension of its length, which allows for example extending it until it extends beyond a locking or unlocking catch corresponding to the insertion of its holding sections 36 into the holding cavities 16 of the cylinder block 10. It is then necessary to again subject the holding element 30 to an elastic deformation in order to withdraw it, which ensures its holding during operation.

Such a tension mounting of the holding element 30 allows in particular ensuring the retention of the holding element 30 despite the force exerted by the pistons 20 during their movement without the recesses of the cylinder block 10. In fact, the force exerted by the holding element 30 on the pistons 20 (or conversely the force exerted by the pistons 20 on the holding element 30) is a radial force, i.e. a force perpendicular to the tension force of the holding element 30 which is a tangential force. On the contrary, a force exerted by the pistons 20 on the holding element 30 will tend to increase the tension in the holding element 30 and thus improve its retention.

In order to improve the holding in position of the holding elements 30 in the channels 14, it is possible to position an elastic element 40 such as a toroidal type seal or "O ring," an annular tension spring, or a split elastic snap ring, for example an outer elastic annulus around each holding element 30.

The holding elements 30 can include a channel on their radially outer surface to receive and hold the elastic element 40. The channel can be made adjacent or not to a boundary of the holding element 30. In the case where the channel is made adjacent to a boundary of the holding element, a lateral wall of the channel is defined by a wall of a channel 14 of the cylinder block 10. The elastic element 40 covers the element 30 radially to prevent its expansion in the radially outer direction relative to the central axis X-X. The elastic element 40 thus holds the holding element 30 pressed to the radially outer surface of the cylinder block 10.

FIGS. 2B and 2C are two partial section views along the plane A-A defined in FIG. 2A, illustrating the two possible positionings previously described.

The holding elements 30 can be made in different manners. Thus two embodiments are shown in FIGS. 4 and 5.

In the embodiment shown in FIG. 4; the holding element 30 has a generally semicircular shape. By associating two holding elements 30 in this embodiment, an annulus or a split annulus is thereby obtained. Thus two of these holding elements 30 are typically positioned around a cylinder block 10 on either side of the recesses 12 (or a total of 4 retaining elements for a cylinder block comprising a single row of pistons) in order to accomplish holding of the piston 20 assembly disposed in the recesses 12. This embodiment is particularly suited to cylinder blocks 10 comprising an even number of pistons.

Figure 5:
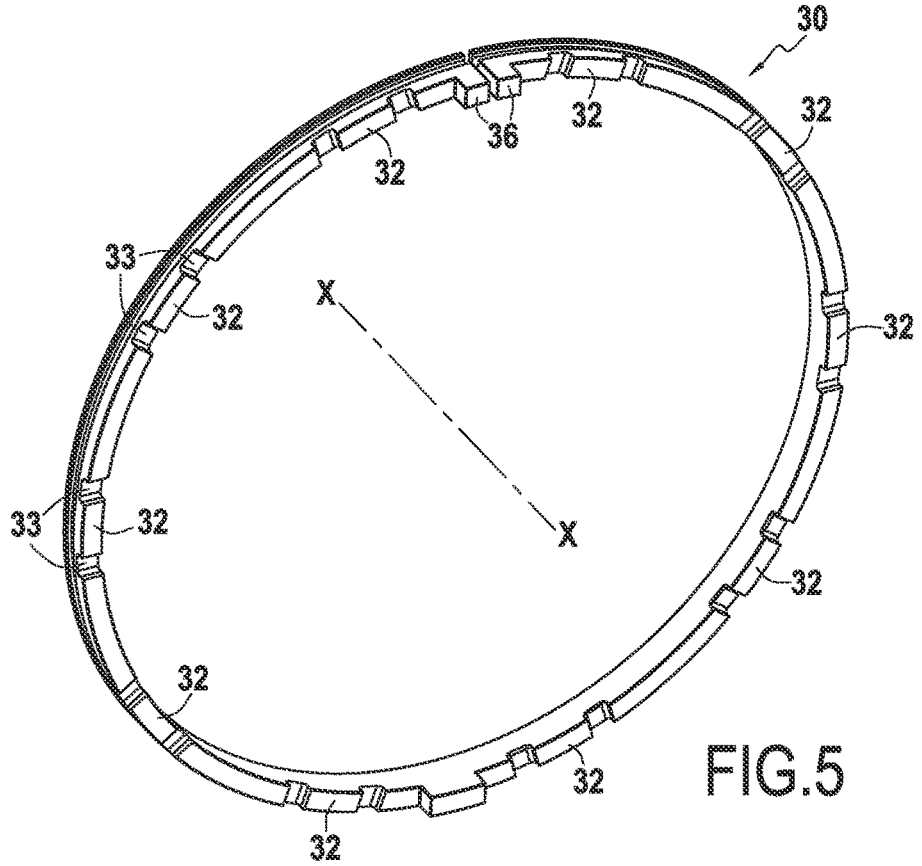
FIG. 5 shows a holding element according to one aspect of the present invention.

In the embodiment shown in FIG. 5, the holding element 30 has the general shape of a split annulus. This embodiment can be suitable if the cylinder block 10 comprises an even or odd number of pistons 20. A holding element 30 of this type is then typically positioned on each side of the different recesses 12 around the cylinder block 10 (or a total of 2 holding elements for a cylinder block comprising a single row of pistons).

It is also understood that holding elements 30 according to these two embodiments can be combined on the same cylinder block 10, provided that it comprises appropriate holding cavities 16. A cylinder block 10 can thus have a holding element 30 according to the embodiment of FIG. 5 on one side of the different recesses 12, and two holding elements 30 according to the embodiment of FIG. 4 on the other side of the different recesses 12.

Figure 6:
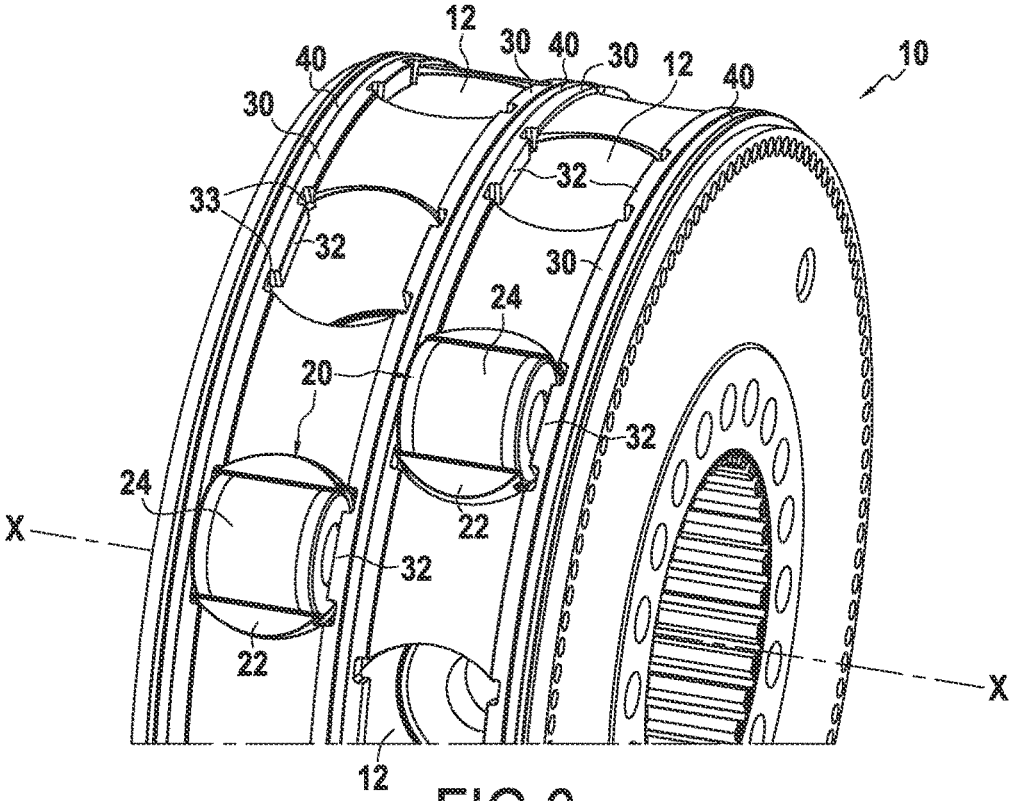
FIG. 6 shows an application of a holding element of one type to that of another type of cylinder block with two rows of pistons.

FIGS. 1 to 3, already described, showed a cylinder block 10 comprising a single row of pistons 20 and of recesses 12. The holding elements 30 can however be employed for a cylinder block having several rows of pistons 20 and of recesses 12. Thus a cylinder block 10 is shown in FIG. 6 comprising two rows of recesses 12. The holding elements disposed at the two ends of the cylinder block 10 relative to the direction defined by the central axis X-X are disposed as already described with reference to FIGS. 1 to 3. The central holding elements 30 are formed here by a single element, and an optional elastic element 40 is positioned in a central channel of this single element. As a variant, the central holding elements 30 can be formed from two distinct elements, each then being able to be surrounded by an elastic element 40 as already described previously with reference in particular to FIGS. 1 and 2A. The holding cavities and the holding sections 36 are positioned here so that each holding element is positioned in an appropriate manner.

The function of the different holding elements 30 remains unchanged.

Figure 7:
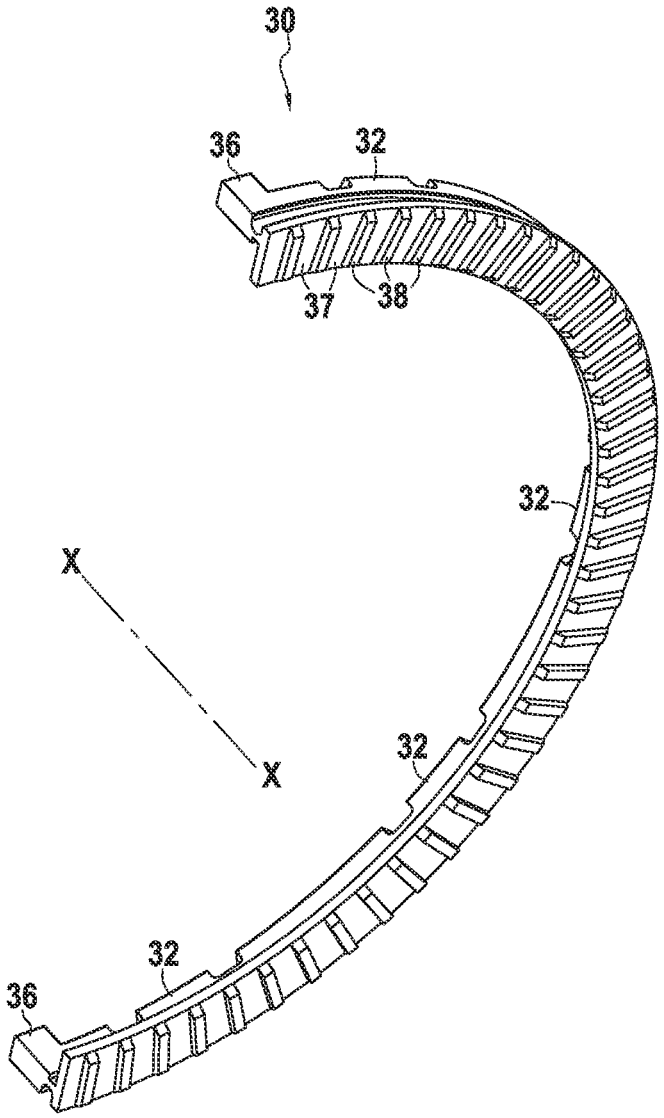
FIG. 7 shows a view of a holding element according to another embodiment or aspect of the present invention.
Figure 8:
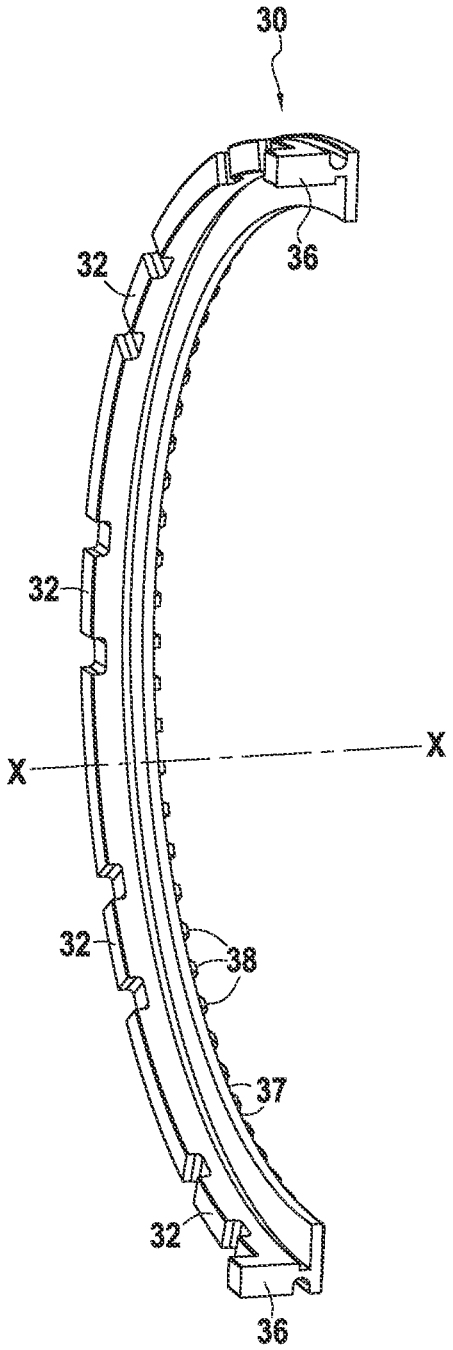
FIG. 8 shows a view of a holding element according to another embodiment or aspect of the present invention.

FIGS. 7 and 8 show two views of another embodiment of a holding element 30.

In this embodiment, the holding element 30 comprises a radial portion 37 extending from an end opposite to the guide portions 32, and equipped with a plurality of patterns 38 distributed regularly over the entire length of the holding element 30. The radial portion 37 has the general shape of an annulus or a portion of an annulus, and thus defines a radial ring.

The radial portion 37 is made so that when the holding element 30 is positioned in a channel of a cylinder block, the radial portion 37 partially covers a face forming an end of the cylinder block 10 in the direction defined by the central axis X-X. The different patterns 38 are thus distributed regularly over the entire periphery of the cylinder block 10, and can be coupled to a sensor in order to accomplish a tachometer function.

The associated sensor can for example be a proximity sensor.

As a variant, the patterns 38 can have a coating such as a magnetic or ferromagnetic coating, and the associated sensor is then a magnetic sensor.

Although the present invention has been described by referring to specific exemplary embodiments, it is clear that modifications and changes can be performed on these examples without departing from the general scope of the invention as defined by the claims. In particular, individual features of the different embodiments illustrated/mentioned can be combined into additional embodiments. Consequently, the description and the drawings should be considered in an illustrative, rather than a restrictive sense.

It is also clear that all the features described with reference to a method can be transposed, alone or in combination, to a device, and conversely, all the features described with reference to a device can be transposed, alone or in combination, to a method.

The invention claimed is:

1. An assembly comprising:

a cylinder block having a plurality of recesses extending radially around a central axis, and leading to an outer periphery of the cylinder block;

a plurality of pistons, each disposed in a recess of the cylinder block having a cylinder-of-revolution cross section around a piston axis extending radially around the central axis, and mounted sliding radially relative to the central axis, each of the plurality of pistons having a body and a crown suited to come into contact with a multi-lobe cam, the crowns having the shape of a cylinder of revolution and two planar ends each in a plane perpendicular to the central axis and defining guide surfaces; and a holding element extending over at least part of the outer periphery of the cylinder block, the holding element comprising a plurality of guide portions, each partially blocking a recess of the cylinder block, so as to come into contact with a planar end of the crown of a piston so as to accomplish the guiding in translation of each of the pistons in their respective recesses, wherein the holding element comprises two indexing means cooperating with two indexing means of the cylinder block so as to hold the holding element under a traction force when positioned around the cylinder block.

2. The assembly according to claim 1, wherein the holding element comprises a body, having the shape of a circular arc extending around the outer periphery of the cylinder block, and holding sections extending perpendicular to the body, parallel to the central axis and from two ends of the body, the holding sections forming the indexing means of the holding element.

3. The assembly according to claim 2, wherein the cylinder block comprises holding cavities provided on the outer surface of the cylinder block, into which are inserted the holding sections of the holding element.

4. The assembly according to claim 3, wherein the holding element comprises a channel extending on an outer surface, and in which an elastic element is positioned in the channel so as to clasp the holding element around the cylinder block.

5. The assembly according to claim 2, wherein the holding element is made of plastic material.

6. The assembly according to claim 2, wherein each of the guide portions defines a linear or planar contact with a planar end of the crown of a piston, the contact being respectively along an axis extending radially relative to the central axis, or in a plane perpendicular to the central axis of the cylinder block.

7. The assembly according to claim 2, wherein each guide portion is bracketed by two notches, each defining a passage for a portion of the body of a piston beyond the holding element in the radial direction relative to the central axis.

8. The assembly according to claim 2, wherein the holding element has a radial portion extending radially relative to the central axis, the radial portion comprising a plurality of relief elements distributed regularly around the central axis.

9. The assembly according to claim 2, wherein the holding element is composed of two segments, said two segments forming an annulus or a split annulus when placed end to end.

10. The assembly according claim 1, wherein the holding element is made of plastic material.

11. The assembly according to claim 10, wherein each guide portion of the holding element is formed in a material comprising one material among molybdenum sulfide, graphite or bronze.

12. The assembly according to claim 1, wherein each of the plurality of guide portions defines a linear or planar contact with a planar end of the crown of a piston, the contact being respectively along an axis extending radially relative to the central axis, or in a plane perpendicular to the central axis of the cylinder block.

13. The assembly according to claim 1, wherein each of the plurality of guide portions is bracketed by two notches, each bracket defining a passage for a portion of the body of a piston beyond the holding element in the radial direction relative to the central axis.

14. The assembly according to claim 13, wherein the body of each piston has a cylinder-of-revolution shape along a piston axis extending radially relative to the central axis, and in which is formed a crown recess defining a cylinder-of-revolution cavity along an axis perpendicular to the piston axis, the crown recess leading to one end of the piston body relative to the piston axis, the intersection between the outer surface of the piston body and the crown recess defining portions suited to penetrate into the notches of the holding element during the translation movement of the piston in its recess.

15. The assembly according to claim 1, wherein the holding element has a radial portion extending radially relative to the central axis, the radial portion comprising a plurality of relief elements distributed regularly around the central axis.

16. The assembly according to claim 15, wherein each of the relief elements comprises a magnetic or ferromagnetic material.

17. The assembly according to claim 1, wherein the holding element is composed of two segments, the two segments forming an annulus or a split annulus when placed end to end.

18. The assembly according to claim 1, wherein the holding element is a split annulus.

19. The assembly according to claim 1, comprising two holding elements extending on either side of the recesses of the cylinder block.

20. A hydraulic machine with radial pistons comprising an assembly according to claim 1.

* * * * *